US010578312B2

(12) United States Patent
Johnson

(10) Patent No.: US 10,578,312 B2
(45) Date of Patent: Mar. 3, 2020

(54) COOKING APPLIANCES HAVING A VENTILATION SYSTEM

(71) Applicant: Haier US Appliance Solutions, Inc., Wilmington, DE (US)

(72) Inventor: Eric Scott Johnson, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 45 days.

(21) Appl. No.: 15/810,191

(22) Filed: Nov. 13, 2017

(65) Prior Publication Data

US 2019/0145627 A1 May 16, 2019

(51) Int. Cl.
*F24C 15/00* (2006.01)
*F24C 7/08* (2006.01)
*F24C 15/20* (2006.01)

(52) U.S. Cl.
CPC ..... *F24C 15/006* (2013.01); *F24C 7/082* (2013.01); *F24C 15/2007* (2013.01)

(58) Field of Classification Search
CPC ..... F24C 15/006; F24C 7/082; F24C 15/2007
USPC ..... 126/21 R, 21 A
See application file for complete search history.

(56) References Cited

U.S. PATENT DOCUMENTS 4,331,124 A * 5/1982 Seidel ..... F24C 14/025 126/21 A
6,772,752 B1 8/2004 Boyer
6,774,347 B2 8/2004 Shon et al.
2013/0174746 A1* 7/2013 Bach ..... G01F 1/06 99/325
2015/0369491 A1* 12/2015 Estrella ..... F24C 15/006 126/21 A

* cited by examiner

*Primary Examiner* — Grant Moubry
*Assistant Examiner* — Benjamin W Johnson
(74) *Attorney, Agent, or Firm* — Dority & Manning, P.A.

(57) ABSTRACT

A cooking appliance having a ventilation system is provided herein. The cooking appliance may include a cabinet, a primary air passage, a fan, and a ventilation sensor. The cabinet may include a top panel and a bottom panel. The cabinet may extend along a vertical direction between the top panel and the bottom panel. The primary air passage may be defined between the top panel and the bottom panel. The primary air passage may extend along a transverse direction between a primary inlet and an exhaust port. The fan may be positioned in fluid communication with the primary air passage downstream from the primary inlet and upstream from the exhaust port. The ventilation sensor may be positioned within the cabinet upstream from the fan and in fluid communication therewith.

15 Claims, 8 Drawing Sheets

COOKING APPLIANCES HAVING A VENTILATION SYSTEM

FIELD OF THE INVENTION

The present subject matter relates generally to cooking appliances and more particularly to cooking appliances having a cooling ventilation system therein.

BACKGROUND OF THE INVENTION

Cooking appliances generally define one or more enclosures supporting one or more heating elements. For instance, oven appliances can include a cabinet defining an insulated cooking chamber therein for receipt of food items for cooking. A cooktop having heating elements may be positioned at a top portion of the cabinet for, as an example, grilling, boiling, or frying food items thereon. Other heating elements, such as a bake heating element or broil heating element may be positioned within the cooking chamber to provide heat to food items located therein. The bake heating element is positioned at a bottom of the cooking chamber. The broil heating element positioned at a top of the cooking chamber. One or more electronic components may be housed within the cabinet outside of the cooking chamber.

During operation of such appliances, one or more heating elements may be energized (e.g., to heat the cooking chamber to a selected cooking temperature). Cooking appliances require features for managing the thermal energy generated by the various heating elements. For example, some appliances define an air plenum or passage between the cabinet and the insulated cooking chamber that houses the appliance controller or heating element junctions. In addition, side panels and other surfaces of oven appliances often require significant cooling to meet regulatory standards.

Therefore, certain cooking appliances include ventilation systems for managing the flow of heated air and regulating component temperatures. For example, a fan may be positioned within an oven appliance to continuously draw out heated air within the air plenum and replenish it with cooler ambient air, thereby cooling the controller or heating element junctions and the cabinet housing them.

In some instances, it may be useful to monitor certain conditions regarding the ventilation system, such as air temperature, air speed, fan rotation, etc. However the high-heat environment within the cabinet, as well as any exhaust particulate drawn from the cooking chamber, make it difficult to use various sensing elements (e.g., electronic sensors) within the ventilation system.

Accordingly, a cooking appliance that provides features for improved thermal management would be useful. More particularly, a cooking appliance having a ventilation system permitting the use of one or more sensing elements would be especially useful.

BRIEF DESCRIPTION OF THE INVENTION

Aspects and advantages of the invention will be set forth in part in the following description, or may be obvious from the description, or may be learned through practice of the invention.

In one aspect of the present disclosure, a cooking appliance is provided. The cooking appliance may include a cabinet, a primary air passage, a fan, and a ventilation sensor. The cabinet may include a top panel and a bottom panel. The cabinet may extend along a vertical direction between the top panel and the bottom panel. The primary air passage may be defined between the top panel and the bottom panel. The primary air passage may extend along a transverse direction between a primary inlet and an exhaust port. The fan may be positioned in fluid communication with the primary air passage downstream from the primary inlet and upstream from the exhaust port. The ventilation sensor may be positioned within the cabinet upstream from the fan and in fluid communication therewith.

In another aspect of the present disclosure, a cooking appliance is provided. The cooking appliance may include a cabinet, an insulated cooking chamber positioned within the cabinet, a primary air passage, a fan, a secondary air passage, and a ventilation sensor. The cabinet may include a top panel and a bottom panel. The cabinet may extend along a vertical direction between the top panel and the bottom panel. The primary air passage may be defined between the top panel and the insulated cooking chamber. The primary air passage may extend along the transverse direction between a primary inlet and an exhaust port. The fan may be positioned in fluid communication with the primary air passage downstream from the primary inlet and upstream from the exhaust port. The secondary air passage may be defined within the cabinet in fluid communication between an ambient air path and the primary air passage. The secondary air passage may be defined in fluid parallel with the primary inlet and downstream therefrom to direct a secondary airflow from the ambient air path to the primary air passage. The ventilation sensor may be positioned along the secondary air passage.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
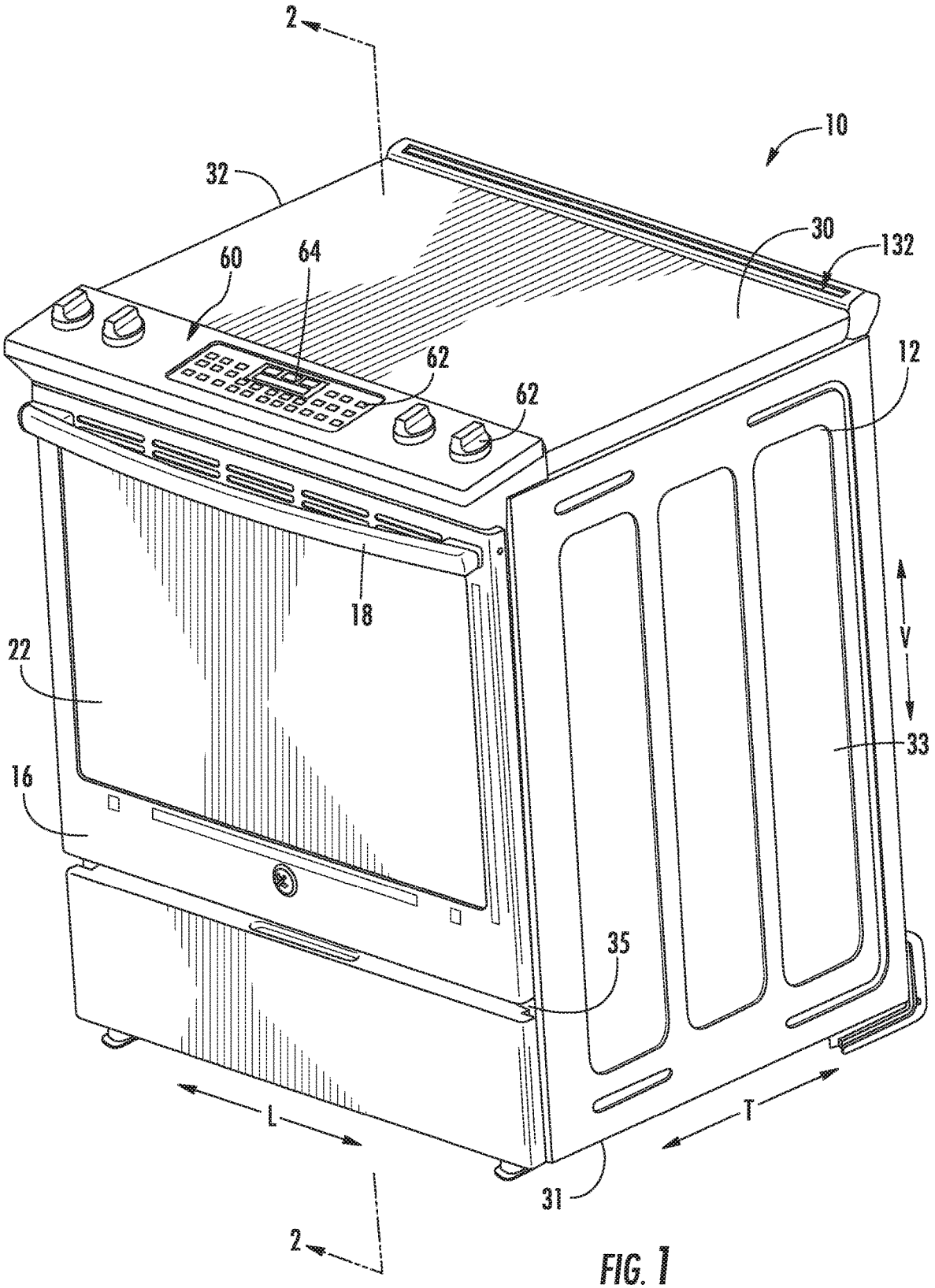
FIG. 1 provides a perspective view of an oven appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In order to aid understanding of this disclosure, several terms are defined below. The defined terms are understood to have meanings commonly recognized by persons of ordinary skill in the arts relevant to the present subject matter. The term "or" is generally intended to be inclusive (i.e., "A or B" is intended to mean "A or B or both"). The terms "first," "second," "primary," and "secondary" may be used interchangeably to distinguish one component from another and are not intended to signify location or importance of the individual components.

Figure 2:
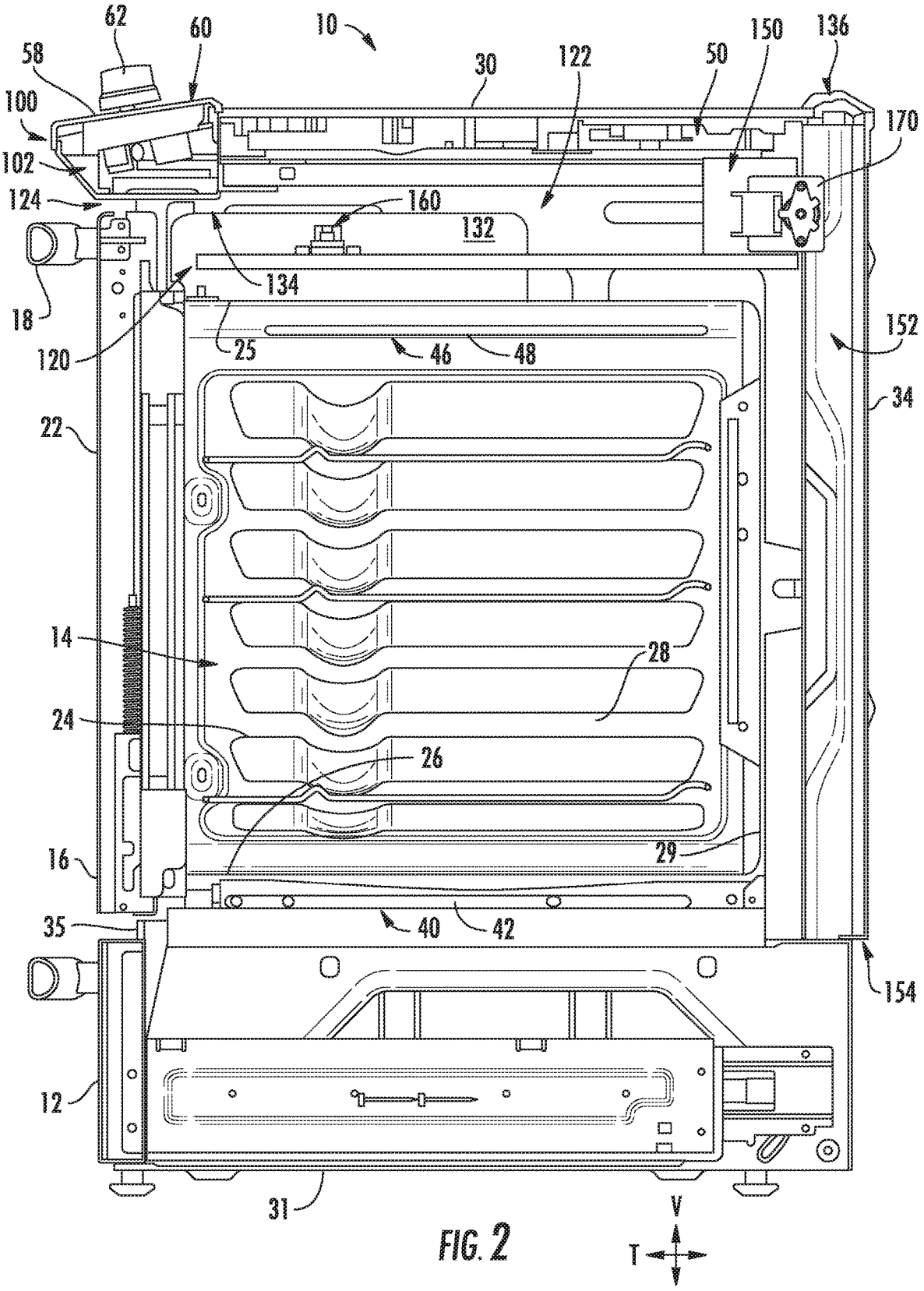
FIG. 2 provides a cross-sectional side view of the exemplary oven appliance of FIG. 1 taken along the line 2-2 of FIG. 1.

Turning to the figures, FIGS. 1 and 2 depict an exemplary cooking appliance (e.g., oven appliance 10) that may be configured in accordance with aspects of the present disclosure. FIG. 1 provides a perspective view of an oven appliance 10 according to exemplary embodiments of the present disclosure. FIG. 2 provides a cross sectional view of oven appliance 10 taken along the 2-2 line of FIG. 1. As shown, oven appliance 10 defines a vertical direction V, a lateral direction L, and a transverse direction T. The vertical direction V, lateral direction L, and transverse direction T are mutually perpendicular and form an orthogonal direction system. As will be understood by those skilled in the art, oven appliance 10 is provided by way of example only, and the present subject matter may be used in any suitable cooking appliance. Thus, the present subject matter may be used with other oven appliances having different configurations, such as wall ovens, electric ovens, gas ovens, microwave ovens, etc.

Oven appliance 10 includes a cabinet 12 with an insulated cooking chamber 14 disposed within cabinet 12. Insulated cooking chamber 14 is configured for the receipt of one or more food items to be cooked. Oven appliance 10 includes a door 16 rotatably mounted to cabinet 12 (e.g., with a hinge—not shown). A handle 18 is mounted to door 16 and assists a user with opening and closing door 16 in order to access insulated cooking chamber 14. For example, a user can pull on handle 18 to open or close door 16 and access insulated cooking chamber 14.

Oven appliance 10 can include a seal (e.g., gasket) between door 16 and cabinet 12 that assists with maintaining heat and cooking fumes within insulated cooking chamber 14 when door 16 is closed as shown. Door 16 may include a window 22, constructed for example from multiple parallel glass panes to provide for viewing the contents of insulated cooking chamber 14 when door 16 is closed and assist with insulating insulated cooking chamber 14. A baking rack may be positioned in insulated cooking chamber 14 for the receipt of food items or utensils containing food items. The baking rack may be slidably received onto embossed ribs 24 or sliding rails such that the baking rack may be conveniently moved into and out of insulated cooking chamber 14 when door 16 is open.

Generally, various sidewalls define insulated cooking chamber 14. For example, insulated cooking chamber 14 includes a top wall 25 and a bottom wall 26 that are spaced apart along the vertical direction V. Left and right sidewalls 28 extend between top wall 25 and bottom wall 26, and are spaced apart along the lateral direction L. A rear wall 29 may additionally extend between the top wall 25 and bottom wall 26 as well as between the left and right sidewalls 28, and is spaced apart from door 16 along the transverse direction T. In this manner, when door 16 is in the closed position, a cooking cavity is defined by door 16 and top wall 25, bottom wall 26, sidewalls 28, rear wall 29, of insulated cooking chamber 14.

In the included figures, walls 25, 26, 28, 29 of insulated cooking chamber 14 are depicted as simple blocks of insulating material surrounding the cooking cavity. However, one skilled in the art will appreciate that the insulating material may be constructed of one or more suitable materials and may take any suitable shape. For example, the insulating material may be encased in one or more rigid structural members, such as sheet metal panels, which provide structural rigidity and a mounting surface for attaching, for example, heating elements, temperature probes, rack sliding assemblies, and other mechanical or electronic components.

As further illustrated, cabinet 12 includes multiple panels that enclose insulated cooking chamber 14. For example, cabinet 12 includes a top panel 30 and a bottom panel 31 that are spaced apart along the vertical direction V. Left panel 32 and right panel 33 (as defined according to the view as shown in FIG. 1) extend between top panel 30 and bottom panel 31, and are spaced apart along the lateral direction L. A rear panel 34 may additionally extend between top panel 30 and bottom panel 31 as well as between left panel 32 and right panel 33, and is spaced apart from door 16 along the transverse direction T. When door 16 is in the closed position, it may sit flush with a front panel or portion 35 of cabinet 12.

In the included figures, panels 30, 31, 32, 33, 34, 35 of cabinet 12 are single ply sheet metal panels, but one skilled in the art will appreciate that any suitably rigid panel may be used while remaining within the scope of the present subject matter. For example, according to exemplary embodiments, panels 30, 31, 32, 33, 34, 35 may be constructed from a suitably rigid and thermally resistant plastic. Additionally or alternatively, each panel 30, 31, 32, 33, 34, 35 may include multiple layers made from the same or different materials, and may be formed in any suitable shape.

A lower heating assembly (e.g., bake heating assembly 40) may be positioned in oven appliance 10, and may include one or more heating elements (e.g., bake heating elements 42). Bake heating elements 42 may be disposed within insulated cooking chamber 14, such as adjacent bottom wall 26. In exemplary embodiments as illustrated, the bake heating elements 42 are electric heating elements, as is generally understood. Alternatively, the bake heating elements 42 may be gas burners or other suitable heating elements having other suitable heating sources. Bake heating elements 42 may generally be used to heat insulated cooking chamber 14 for both cooking and cleaning of oven appliance 10.

Additionally or alternatively, an upper heating assembly (e.g., broil heating assembly 46) may be positioned in oven appliance 10, and may include one or more upper heating elements (e.g., broil heating elements 48). Broil heating elements 48 may be disposed within insulated cooking chamber 14, such as adjacent top wall 25. In exemplary embodiments as illustrated, the broil heating elements 48 are electric heating elements, as is generally understood. Alternatively, the broil heating elements 48 may be gas burners or other suitable heating elements having other suitable heating sources. Broil heating elements 48 may additionally be used to heat insulated cooking chamber 14 for both cooking and cleaning of oven appliance 10.

Figure 3:
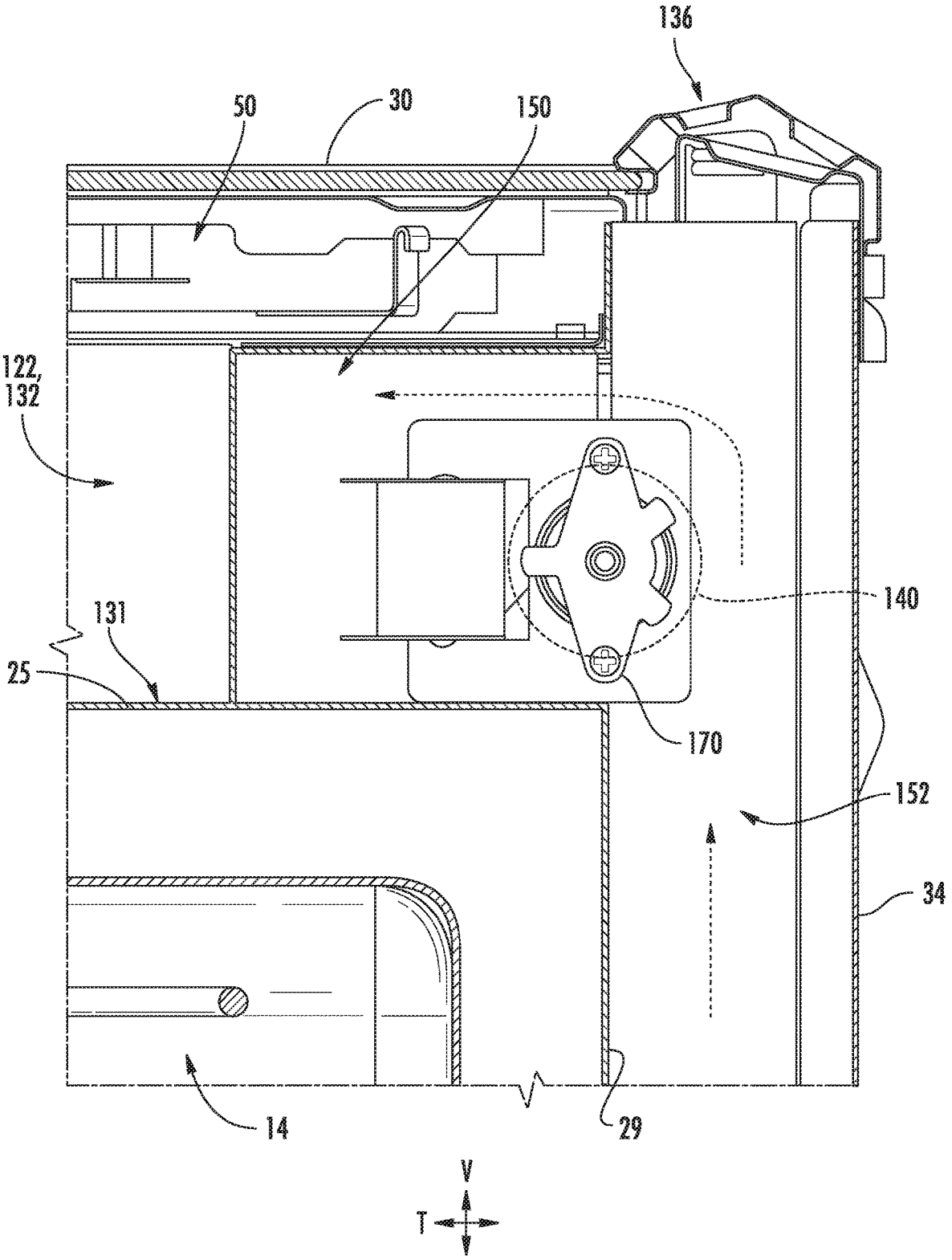
FIG. 3 provides a magnified cross-sectional side view of a portion of the exemplary appliance of FIG. 2.

In some embodiments, oven appliance 10 includes a cooktop positioned at top panel 30 of oven appliance 10. In such embodiments, top panel 30 may be a generally planar member having an upper surface that is perpendicular to the vertical direction V. In particular, top panel 30 may be formed from glass, glass ceramic, metal, or another suitable material. A plurality of heating assemblies (e.g., cooktop heating assemblies 50) may be mounted to or otherwise positioned on top panel 30. In some embodiments, heating assemblies 50 are positioned above insulated cooking chamber 14 of cabinet 12 (i.e., higher relative to the vertical direction V). Optionally, heating assemblies 50 may extend between cooking chamber 14 and top panel 30, within an open region 122 that is defined between top panel 30 and the insulated cooking chamber 14. Cooking utensils, such as pots, pans, griddles, etc., may be placed on top panel 30 and heated with heating assemblies 50 during operation of the cooktop. In FIGS. 1 through 3, heating assemblies 50 are shown as radiant heating elements mounted below top panel 30. However, in alternative example embodiments, heating assemblies 50 may be any suitable heating assembly, such as gas burner elements, resistive heating elements, induction heating elements, etc.

Oven appliance 10 is further equipped with a controller 58 to regulate operation of the oven appliance 10. For example, controller 58 may regulate the operation of oven appliance 10, including activation of heating elements 42, 48, 50, as well as heating assemblies 40, 46 generally. Controller 58 may be in operable communication (e.g., via a suitable electronic wired connection) with the heating elements 42, 48, 50 and other components of the oven appliance 10, as discussed herein. In general, controller 58 may be operable to configure the oven appliance 10 (and various components thereof) for cooking. Such configuration may be based on a plurality of cooking factors of a selected operating cycles, sensor feedback, etc.

By way of example, controller 58 may include one or more memory devices (e.g., non-transitive media) and one or more microprocessors, such as general or special purpose microprocessors operable to execute programming instructions or micro-control code associated with an operating cycle. The memory may represent random access memory such as DRAM, or read only memory such as ROM or FLASH. In exemplary embodiments, the processor executes programming instructions stored in memory. The memory may be a separate component from the processor or may be included onboard within the processor.

Controller 58 may be positioned in a variety of locations throughout oven appliance 10. For instance, controller 58 may be located within a user interface panel 60 of oven appliance 10, as shown in FIG. 2. In some such embodiments, input/output ("I/O") signals may be routed between the control system and various operational components of oven appliance 10 along wiring harnesses that may be routed through cabinet 12. In some embodiments, controller 58 is in operable communication (e.g., electronic or wireless communication) with user interface panel 60 and controls 62, through which a user may select various operational features and modes and monitor progress of oven appliance 10. In optional embodiments, user interface panel 60 may represent a general purpose I/O ("GPIO") device or functional block. In certain embodiments, user interface panel 60 includes input components or controls 62, such as one or more of a variety of electrical, mechanical or electromechanical input devices including rotary dials, push buttons, and touch pads. Additionally or alternatively, user interface panel 60 may include a display component, such as a digital or analog display device 64 designed to provide operational feedback to a user.

User interface panel 60 may be in operable communication with controller 58 via one or more signal lines or shared communication busses. Controller 58 may also be in similar operable communication with a fan 140 and one or more sensors (e.g., a ventilation sensor 170), as discussed in detail below.

It should be appreciated that the invention is not limited to any particular style, model, or configuration of oven appliance 10. The exemplary embodiments depicted in the figures are for illustrative purposes only. For example, different locations may be provided for user interface panel 60, different configurations may be provided for the baking rack or ribs 24, different cooling air flow paths may be utilized, and other differences may be applied as well. In addition, oven appliance 10 may be a wall oven, a range appliance, an oven/range combo, a microwave oven, an electric oven, a gas oven, etc.

Referring now generally to FIGS. 2 through 6, oven appliance 10 further includes a ventilation assembly 120 defining a primary air passage 132. Ventilation assembly 120 may be generally configured to direct air through (e.g., into and out of) a portion of cabinet 12. As shown, insulated cooking chamber 14 is positioned within cabinet 12 such that a primary air passage 132 is defined within open region 122 between top panel 30 and the insulated cooking chamber 14 (e.g., at top wall 25). Thus, primary air passage 132 may be at least partially defined by a height or space along the vertical direction V between top panel 30 and bottom panel 31.

As illustrated, primary air passage 132 also extends along the transverse direction T. In particular, primary air passage 132 may extend between a primary inlet 124 and an exhaust port 136. Primary inlet 124 may be positioned at or adjacent the front portion 35 of cabinet 12. In some such embodiments, primary inlet 124 of ventilation assembly 120 is also positioned above and adjacent or proximate to door 16 (e.g., when door 16 is in the closed position).

Exhaust port 136 may be generally positioned adjacent or proximate rear panel 34 of cabinet 12. Moreover, exhaust port 136 is generally configured to discharge hot air from within cabinet 12 (e.g., at primary air passage 132). For example, exhaust port 136 may be defined in top panel 30 of oven appliance proximate to rear panel 34 of cabinet 12. By placing exhaust port 136 in a top, back corner of cabinet 12, hot air may be exhausted up and away from both oven appliance 10 and its user. Alternatively, exhaust port 136 may be defined in rear panel 34 of cabinet 12, such that it is not visible to the user, or may be positioned at any other suitable location. Also alternatively, exhaust port 136 may be coupled to an exhaust duct which routes heated air out of the room or ambient environment in which oven appliance 10 is located.

In some embodiments, a primary duct 130 defines at least a portion of primary air passage 132. For example, primary duct 130 may be mounted on a top surface 131 of the insulated cooking chamber 14 (e.g., at top wall 25 opposite the insulated cooking chamber 14). Primary duct 130 may extend along the transverse direction T between a duct inlet 134 and exhaust port 136.

As shown, duct inlet 134 is positioned toward a front portion of oven appliance 10 (e.g., closer, along the transverse direction T, to control panel 100 and front panel 35 of cabinet 12 than a rear panel 34 of oven appliance 10). In certain embodiments, duct inlet 134 is positioned within a front half of oven appliance 10 along the transverse direction T. In some such embodiments, duct inlet 134 may be attached to control panel 100 such that electronics chamber 102 is placed in direct, sealed fluid communication with primary air passage 132. In such a configuration, air is drawn through inlet 134 only from electronics chamber 102 and not from elsewhere within cabinet 12. However, in alternative exemplary embodiments, duct inlet 134 is open to the rest of the open region 122 (e.g., between top wall 25 and top panel 30).

A fan 140 is positioned within the cabinet 12 in fluid communication with primary air passage 132. In particular fan 140 is mounted within primary air passage 132 to motivate air therethrough. Generally, fan 140 is configured to draw air from primary inlet 124 (e.g., through electronics chamber 102) and discharging it out of exhaust port 136. Thus, fan 140 is positioned downstream from primary inlet 124 and upstream from exhaust port 136. According to the illustrated embodiments, fan 140 is a tangential fan that is positioned toward a back end of duct 130 proximate to rear panel 34 of cabinet 12. However, one skilled in the art will appreciate that any other suitable fan type, position, or configuration may be used while remaining within the scope of the present subject matter. For example, fan 140 could instead be a radial fan positioned toward a front end of duct 130. Indeed, any suitable fan and duct arrangement configured for exhausting air from primary inlet 124 out of exhaust port 136 may be used.

In some embodiments, a secondary air passage 150 is defined upstream from fan 140 within cabinet 12. As shown, secondary air passage 150 may be in fluid communication with primary air passage 132 independent from primary inlet 124. Thus, secondary air passage 150 may be defined in fluid parallel to primary inlet 124. Air flowing through secondary air passage 150 is directed to primary air passage 132 without passing through primary inlet 124, and air flowing through primary 124 is directed to primary air passage 132 without passing through secondary air passage 150. As shown, secondary air passage 150 may connect to (e.g., direct air to) primary air passage 132 at a position or location downstream from primary inlet 124. An ambient air path 152 (e.g., defined between rear panel 34 and rear wall 29 of insulated cooking chamber 14) may be upstream from secondary air passage 150. In such embodiments, secondary air passage 150 is in fluid communication between an ambient air path 152 and the primary air passage 132 at a location downstream from the primary inlet 124. During use, ambient air may flow along the ambient air path 152 from an ambient inlet 154 and to secondary air passage 150. As illustrated, ambient inlet 154 may be defined between rear panel 34 and rear wall 29. However, alternative embodiments may provide an ambient inlet at a front portion 35 of cabinet 12, below door 16, or at another suitable location.

In certain embodiments, a chamber vent 160 is defined through insulated cooking chamber 14 (e.g., through top wall 25) in fluid communication with the primary air passage 132. In particular, chamber vent 160 may be defined through top wall 25 along primary air passage at a location upstream from fan 140. Additionally or alternatively, chamber vent 160 may be defined in fluid parallel to secondary air passage 150. During operations, air may thus pass directly from the insulated cooking chamber 14 and to the primary air passage 132 without first flowing through secondary air passage 150 and, optionally, primary inlet 124. Negative pressure created by fan 140 may draw exhaust air from insulated cooking chamber 14 and into primary air passage 132 before flowing from cabinet 12 through exhaust port 136. A chamber duct 162 may be mounted over chamber vent 160 and attach to primary duct 130 (e.g., in fluid communication therewith) at a location upstream from fan 140. Thus, exhaust air from insulated cooking chamber 14 may flow through chamber duct 162 before entering the primary duct 130. In alternative embodiments, however, ventilation assembly 120 may be in fluid isolation from insulated cooking chamber 14 14 (e.g., such that air is not exchanged directly therebetween).

In some embodiments, ventilation assembly 120 includes one or more sensors (e.g., a ventilation sensor 170) positioned within cabinet 12. Ventilation sensor 170 may be in operable communication (e.g., electronic or wireless communication) with controller 58 and is generally configured to detect one or more characteristics for ventilation assembly 120. For example, ventilation sensor 170 may be a fan speed sensor configured to detect a rotation speed of fan 140. In some such embodiments, the fan speed sensor (e.g., ventilation sensor 170) is mounted adjacent to fan 140 (e.g., along an axis of rotation of fan 140). The fan speed sensor may be any suitable electronic sensor for detecting the rotation speed of fan 140, such as a Hall Effect sensor or other magnetic field sensor for sensing rotation of fan 140. In additional or alternative embodiments, ventilation sensor 170 is provided as an air sensor (e.g., temperature sensor or thermistor, air speed sensor, humidity sensor, etc.) configured to detect a characteristic (e.g., temperature, velocity, humidity, etc.) of air within cabinet 12.

As shown, exemplary embodiments provide ventilation sensor 170 at a position along secondary air passage 150. In some such embodiments, ventilation sensor 170 is upstream from fan 140. Thus, relatively cool air (e.g., from ambient air path 152) may be advantageously motivated across ventilation sensor 170, cooling ventilation sensor 170 and preventing smoke or exhaust air (e.g., from within insulated cooking chamber 14) from passing across ventilation sensor 170.

In certain embodiments, an internal back panel 172 is positioned within cabinet 12 between ambient air path 152 and secondary air passage 150. For instance, internal back panel 172 may be mounted on an outer surface of insulated cooking chamber 14 (e.g., above rear wall 29). Moreover, internal back panel 172 may span at least a portion of insulated cooking chamber 14 along the lateral direction L. Additionally or alternatively, internal back panel 172 may extend along the vertical direction V between insulated cooking chamber 14 and top panel 30. Internal back panel 172 may thus generally separate open region 122 from the ambient air path 152 or rear panel 34. However, a panel intake port 174 defined through internal back panel 172 (e.g., along the transverse direction T) may form a portion of the secondary air passage 150 and direct air from ambient air path 152 to the ventilation sensor 170. Optionally, secondary air passage 150 is aligned with ventilation sensor 170 along the transverse direction T upstream from fan 140. Alternatively, no internal back panel 172 may be provided and the area between rear panel 34 and insulated cooking chamber 14 may be generally open to permit free air flow therebetween.

Figure 4:
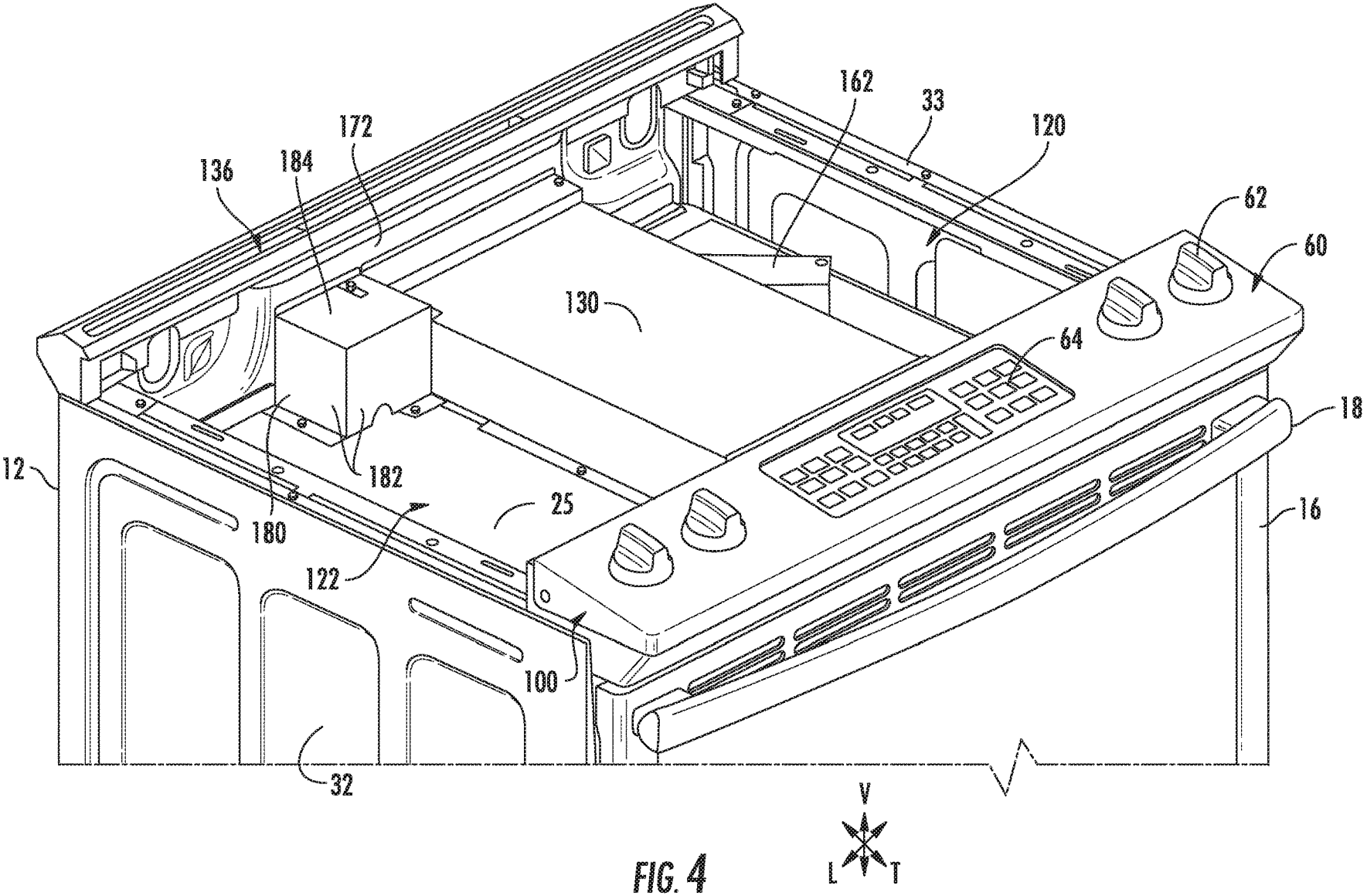
FIG. 4 provides a perspective view of the exemplary oven appliance of FIG. 1, wherein a top panel has been removed for clarity of illustration.
Figure 5:
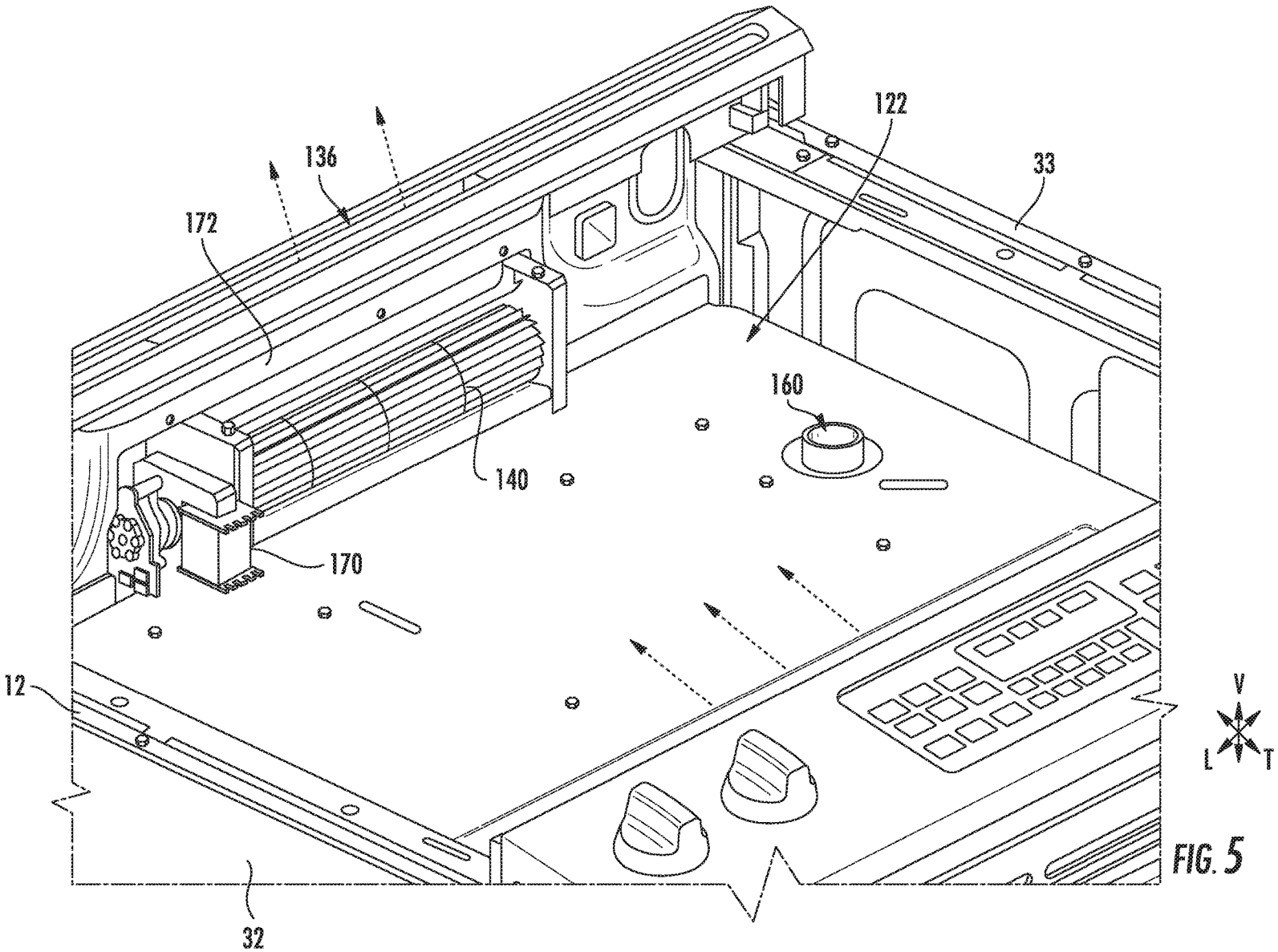
FIG. 5 provides a perspective view of the exemplary oven appliance of FIG. 4, wherein multiple ducts have been removed for clarity of illustration.
Figure 6:
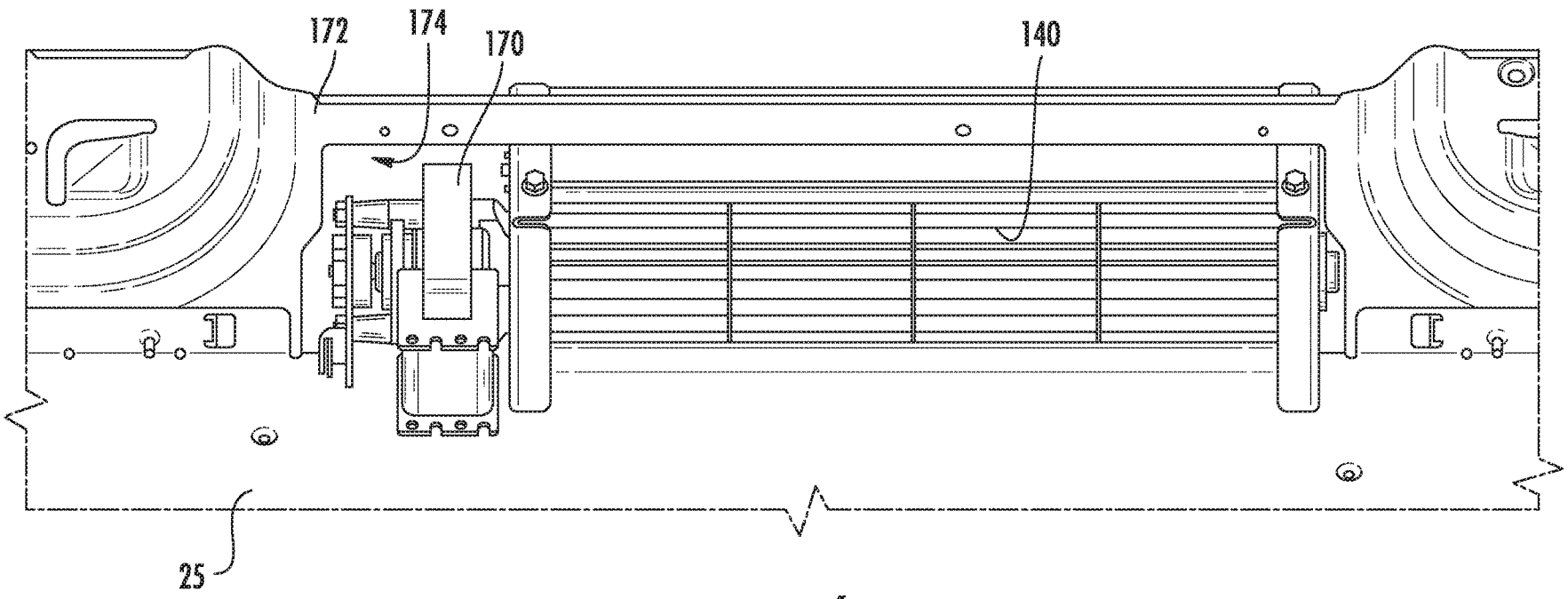
FIG. 6 provides a magnified perspective view of a portion the exemplary oven appliance of FIG. 5 according to certain exemplary embodiments.
Figure 7:
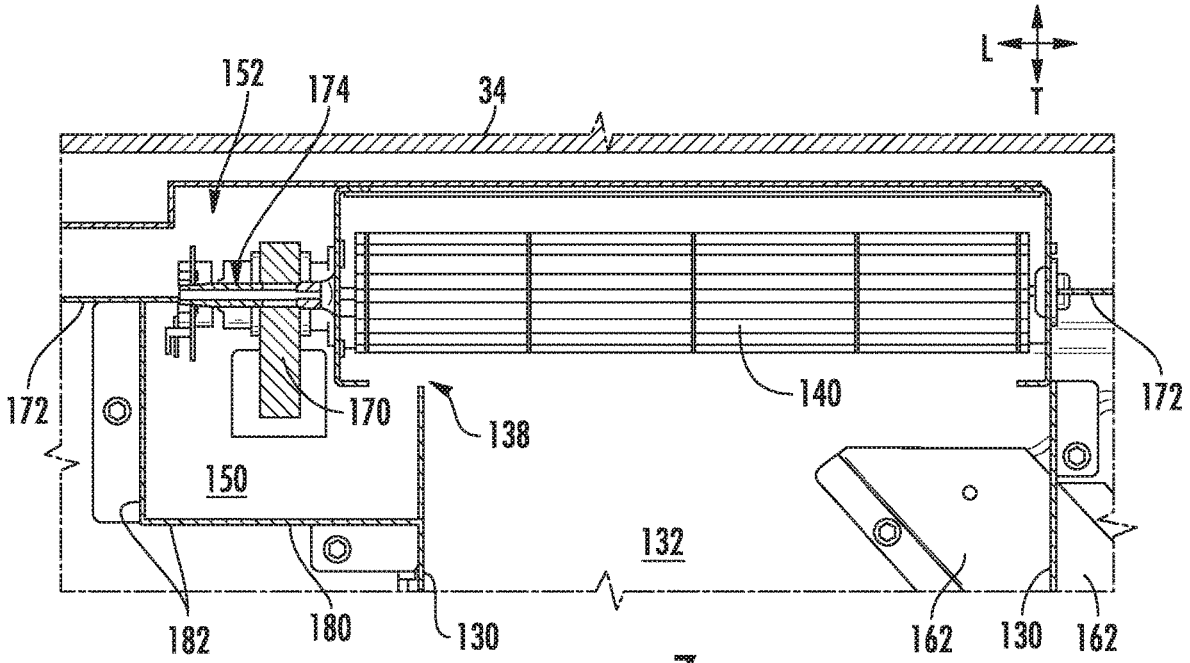
FIG. 7 provides a magnified overhead sectional view of a portion of the exemplary oven appliance of FIG. 4.
Figure 8:
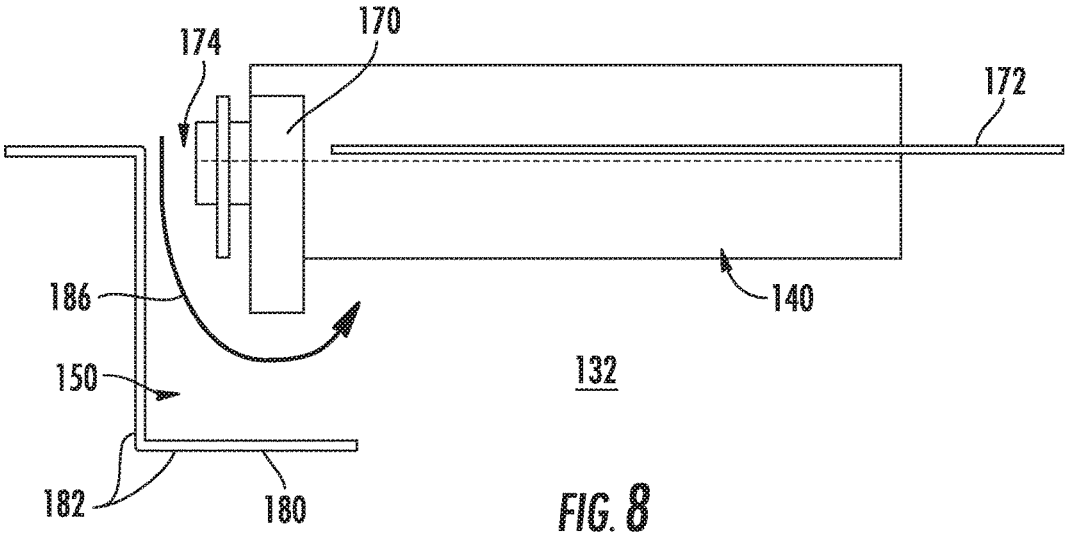
FIG. 8 provides a schematic view of a portion of the oven appliance of FIG. 7.

Turning now to FIGS. 7 and 8, various overhead views are provided of oven appliance 10 at the rear portion thereof. As shown, in some embodiments, a secondary duct 180 may be positioned adjacent to ventilation sensor 170. In particular, secondary duct 180 may define a portion of secondary air passage 150 about ventilation sensor 170. In some such embodiments, one or more duct walls, such as one or more vertical duct walls 182 and horizontal duct wall 184 (FIG. 4), enclose ventilation sensor 170 from the surrounding portion of open region 122 (FIG. 4). For instance, vertical duct walls 182 may extend in the vertical direction V from top wall 25 of insulated cooking chamber 14, thereby guiding horizontal air flow (as indicated by arrow 186) as it is motivated toward fan 140. In some embodiments, air flow 186 travels from secondary air passage 150 to primary air passage 132 through a duct opening 138 defined, for instance, through a side wall of primary duct 130 (e.g., through primary air passage 132). Horizontal duct wall 184 may extend from vertical duct walls 182 at a non-parallel angle to vertical direction V (e.g., perpendicular to vertical direction V) above secondary air passage 150, further guiding air and restricting vertical movement thereof.

In optional embodiments, secondary duct 180 (e.g., one or more duct walls 182, 184) is mounted on internal back panel 172. In turn, air flow 186 through secondary air passage 150 travels downstream from panel intake port 174 and directly to secondary duct 180. However, as noted above, alternative embodiments may not include internal back panel 172. In some such embodiments, air flow 186 through secondary air passage 150 will thus enter secondary duct 180 directly from open region 122 before flowing to fan 140.

Figure 9:
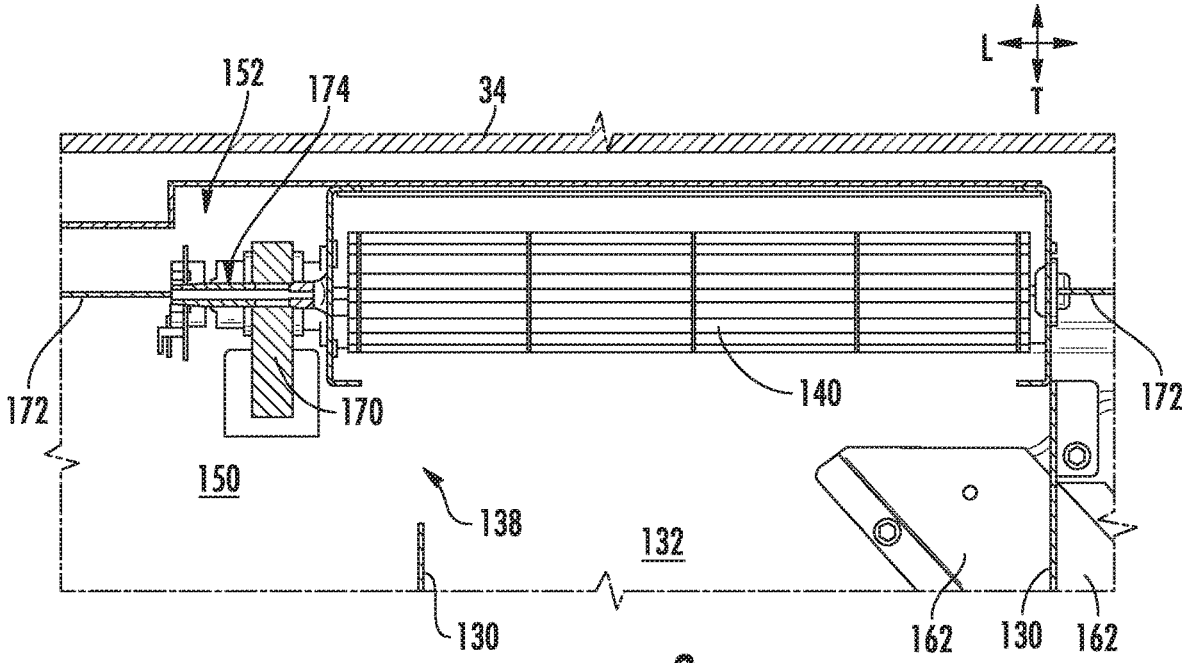
FIG. 9 provides a magnified overhead view of a portion of an oven appliance and according to exemplary embodiments of the present disclosure.
Figure 10:
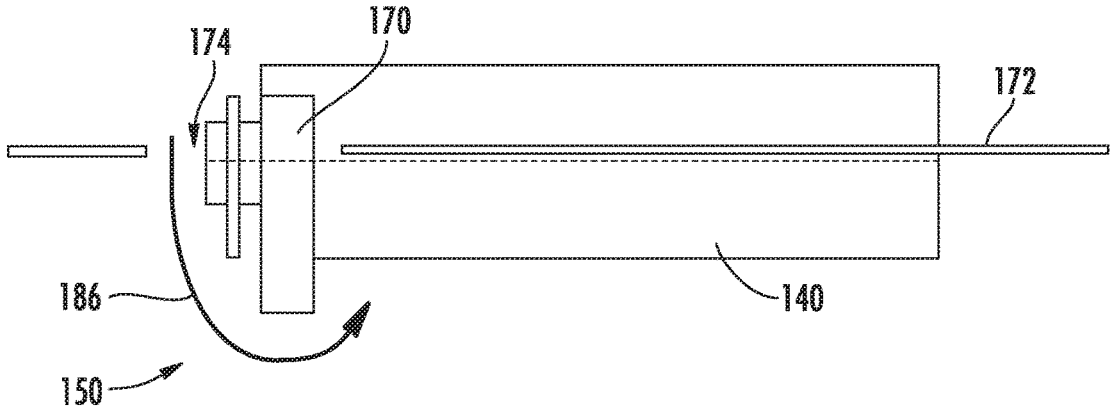
FIG. 10 provides a schematic view of a portion of the oven appliance of FIG. 9.

Turning now to FIGS. 9 and 10, various overhead views are provided of oven appliance 10 at the rear portion thereof, according to alternative embodiments. Although provided as alternative embodiments, it is understood that the embodiments of FIGS. 9 and 10 are substantially identical to the above described embodiments, except as otherwise indicate. For instance, secondary air passage 150 may be provided without a secondary duct structure. Horizontal air flow (as indicate by arrow 186) may flow freely across ventilation sensor 170 (e.g., from panel intake port 174) as motivated by fan 140. In some such embodiments, air flow 186 travels from secondary air passage 150 to primary air passage 132 through a duct opening 138 defined, for instance, through a side wall of primary duct 130 (e.g., through primary air passage 132).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooking appliance defining a vertical direction, a lateral direction, and a transverse direction, the cooking appliance comprising:

a cabinet comprising a top panel and a bottom panel, the cabinet extending along the vertical direction between the top panel and the bottom panel;

a primary air passage defined between the top panel and the bottom panel, the primary air passage extending along the transverse direction between a primary inlet and an exhaust port;

a fan configured to generate an airflow and positioned in fluid communication with the primary air passage downstream from the primary inlet and upstream from the exhaust port;

a ventilation sensor positioned within the cabinet upstream from the fan and in fluid communication therewith; and a secondary air passage defined within the cabinet that fluidly connects an ambient air path and the primary air passage, the secondary air passage being in fluid communication with the primary air passage at a location downstream from the primary inlet, wherein the ventilation sensor is a fan speed sensor configured to detect a rotation speed of the fan, wherein the fan speed sensor is physically mounted to a casing of the fan and disposed adjacent to the fan and within the secondary air passage, and wherein the secondary air passage redirects an airflow to the primary air passage from a direction counter to an airflow through the primary air passage.

2. The cooking appliance of claim 1, further comprising a primary duct mounted on a surface within the cabinet, wherein the primary duct defines a portion of the primary air passage.

3. The cooking appliance of claim 2, further comprising a secondary duct defining a portion of the secondary air passage, wherein the ventilation sensor is positioned within the secondary air passage at the portion defined by the secondary duct.

4. The cooking appliance of claim 1, further comprising an insulated cooking chamber positioned within the cabinet; and a chamber vent defined through the insulated cooking chamber in fluid communication with the primary air passage at a location upstream from the fan.

5. The cooking appliance of claim 4, wherein the secondary air passage is defined in fluid parallel with the chamber vent such that fluids through the secondary air passage flow separately from fluids through the chamber vent.

6. The cooking appliance of claim 1, wherein the cabinet comprises an internal back panel, and wherein the internal back panel defines a sensor intake along the secondary air passage.

7. The cooking appliance of claim 6, further comprising a secondary duct mounted on the internal back panel, the secondary duct defining a portion of the secondary air passage, wherein the ventilation sensor is positioned within the secondary air passage at the portion defined by the secondary duct.

8. A cooking appliance defining a vertical direction, a lateral direction, and a transverse direction, the cooking appliance comprising:

a cabinet comprising a top panel and a bottom panel, the cabinet extending along the vertical direction between the top panel and the bottom panel;

an insulated cooking chamber positioned within the cabinet;

a primary air passage defined between the top panel and the insulated cooking chamber, the primary air passage extending along the transverse direction between a primary inlet and an exhaust port;

a fan configured to generate an airflow and positioned in fluid communication with the primary air passage downstream from the primary inlet and upstream from the exhaust port;

a secondary air passage defined within the cabinet that fluidly connects an ambient air path and the primary air passage, the secondary air passage being defined in fluid parallel with the primary inlet such that fluids through the secondary air passage flow separately into the primary air passage from fluids through the primary inlet, and wherein the secondary air passage is further defined downstream from the primary inlet along the primary air passage to direct a secondary airflow from the ambient air path to the primary air passage at a location downstream from the primary inlet; and a ventilation sensor positioned along the secondary air passage, wherein the ventilation sensor is a fan speed sensor configured to detect a rotation speed of the fan, wherein the fan speed sensor is physically mounted to a casing of the fan and disposed adjacent to the fan and within the secondary air passage, and wherein the secondary air passage redirects an airflow to the primary air passage from a direction counter to an airflow through the primary air passage.

9. The cooking appliance of claim 8, further comprising a primary duct mounted on a surface of the insulated cooking chamber, wherein the primary duct defines a portion of the primary air passage.

10. The cooking appliance of claim 9, further comprising a secondary duct defining a portion of the secondary air passage, wherein the ventilation sensor is positioned within the secondary air passage at the portion defined by the secondary duct.

11. The cooking appliance of claim 8, further comprising a chamber vent defined through the insulated cooking chamber in fluid communication with the primary air passage at a location upstream from the fan.

12. The cooking appliance of claim 11, wherein the secondary air passage is defined in fluid parallel with the chamber vent such that fluids through the secondary air passage flow separately from fluids through the chamber vent.

13. The cooking appliance of claim 9, wherein the cabinet comprises an internal back panel, and wherein the internal back panel defines a sensor intake along the secondary air passage.

14. The cooking appliance of claim 13, further comprising a secondary duct mounted on the internal back panel, the secondary duct defining a portion of the secondary air passage, wherein the ventilation sensor is positioned within the secondary air passage at the portion defined by the secondary duct.

15. A cooking appliance defining a vertical direction, a lateral direction, and a transverse direction, the cooking appliance comprising:

a cabinet comprising a top panel and a bottom panel, the cabinet extending along the vertical direction between the top panel and the bottom panel;

a primary air passage defined between the top panel and the bottom panel, the primary air passage extending along the transverse direction between a primary inlet and an exhaust port;

a fan positioned in fluid communication with the primary air passage downstream from the primary inlet and upstream from the exhaust port;

a ventilation sensor positioned within the cabinet upstream from the fan and in fluid communication therewith; and a secondary air passage defined within the cabinet that fluidly connects an ambient air path and the primary air passage, the secondary air passage being in fluid communication with the primary air passage at a location downstream from the primary inlet, wherein the secondary air passage redirects an airflow to the primary air passage from a direction counter to an airflow through the primary air passage.

* * * * *